US009932686B2

(12) United States Patent
Fulconis et al.

(10) Patent No.: US 9,932,686 B2
(45) Date of Patent: Apr. 3, 2018

(54) METHOD AND DEVICE FOR DECONTAMINATING A METALLIC SURFACE

(75) Inventors: Jean-Michel Fulconis, Roquemaure (FR); Jacques Delagrange, Saint Paulet de Caisson (FR); Francis Dalard, Meylan (FR); Jean-Pierre Caire, Saint-Ismier (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 13/123,870

(22) PCT Filed: Oct. 12, 2009

(86) PCT No.: PCT/EP2009/063281
§ 371 (c)(1),
(2), (4) Date: May 4, 2011

(87) PCT Pub. No.: WO2010/043591
PCT Pub. Date: Apr. 22, 2010

(65) Prior Publication Data

US 2011/0259759 A1 Oct. 27, 2011

(30) Foreign Application Priority Data

Oct. 13, 2008 (FR) ..... 08 56911

(51) Int. Cl.
*C25F 7/02* (2006.01)
*G21F 9/28* (2006.01)
(Continued)

(52) U.S. Cl.
CPC ..... *C25F 1/04* (2013.01); *C25F 1/06* (2013.01); *C25F 3/02* (2013.01); *C25F 3/06* (2013.01);
(Continued)

(58) Field of Classification Search
CPC .. G21F 9/002–9/004; G21F 9/28–9/30; B23H 3/00–3/10; C25F 3/06
(Continued)

(56) References Cited

U.S. PATENT DOCUMENTS 2,409,097 A 10/1946 Batcheller
4,312,758 A * 1/1982 Berton et al. ..... 210/709
(Continued)

FOREIGN PATENT DOCUMENTS

BE 465381 6/1946
DE 102 59 365 A1 10/2003
(Continued)

OTHER PUBLICATIONS

Lee et al., Application of a Modified Electrochem. System for Surface Decontamination of Radioactive Metal Waste, Transactions of the 17th International Conference on Structural Mechanics in Reactor Tech. (2003).*
(Continued)

*Primary Examiner* — Bryan D. Ripa
*Assistant Examiner* — Ho-Sung Chung
(74) *Attorney, Agent, or Firm* — Miles & Stockbridge P.C.

(57) ABSTRACT

The present invention concerns a method and device for oxidative erosion or for decontamination of a metallic surface, comprising a step consisting of intermittently polarizing the metallic surface to be eroded or decontaminated, placed in contact with a solution containing manganese VII, at a more anodic electric potential than the corrosion potential of said surface.

20 Claims, 4 Drawing Sheets

(51) Int. Cl.

| | |
|---|---|
| ***C25F 3/06*** | (2006.01) |
| ***C25F 1/04*** | (2006.01) |
| ***C25F 1/06*** | (2006.01) |
| ***C25F 3/02*** | (2006.01) |
| ***G21F 9/00*** | (2006.01) |

(52) U.S. Cl.
CPC ..... *C25F 7/02* (2013.01); *G21F 9/004* (2013.01); *G21F 9/28* (2013.01)

(58) Field of Classification Search
USPC ..... 205/674
See application file for complete search history.

(56) References Cited

U.S. PATENT DOCUMENTS

| | | | | |
|---|---|---|---|---|
| 4,401,532 | A * | 8/1983 | Jackson | C25F 3/00 204/225 |
| 4,481,090 | A * | 11/1984 | Childs | G21F 9/004 205/684 |
| 4,615,776 | A * | 10/1986 | Sasaki et al. | 205/660 |
| 4,859,287 | A | 8/1989 | Sone et al. | |
| 5,093,072 | A | 3/1992 | Guy et al. | |
| 5,439,562 | A * | 8/1995 | Snyder | C25C 1/08 205/594 |
| 5,877,388 | A * | 3/1999 | Enda | G21F 9/004 204/225 |
| 5,897,765 | A * | 4/1999 | Mercier | 205/743 |
| 6,290,461 | B1 * | 9/2001 | Wei | B23H 3/04 204/224 M |
| 6,635,232 | B1 | 10/2003 | Yaita et al. | |
| 6,702,902 | B1 * | 3/2004 | Fulconis et al. | 134/3 |
| 2005/0057004 | A1 * | 3/2005 | Yamazaki | C23C 28/00 277/592 |
| 2005/0082257 | A1 | 4/2005 | Bierings et al. | |
| 2005/0269296 | A1 * | 12/2005 | Arakawa et al. | 219/69.12 |
| 2006/0137995 | A1 * | 6/2006 | Ghosh | C23F 1/38 205/674 |
| 2008/0202552 | A1 * | 8/2008 | Kool | C23C 10/18 134/2 |
| 2010/0168497 | A1 * | 7/2010 | Enda | G21F 9/002 588/1 |

FOREIGN PATENT DOCUMENTS

| | | | | |
|---|---|---|---|---|
| FR | 928916 | A | 12/1947 | |
| FR | 2 641 895 | A1 | 7/1990 | |
| FR | 2 644 618 | | 9/1990 | |
| FR | 2 792 763 | A1 | 10/2000 | |
| FR | 2 850 673 | A1 | 8/2004 | |
| GB | 553326 | | 5/1943 | |
| JP | 9 295224 | | 11/1997 | |
| RU | 2169404 | C2 * | 10/2000 | G21F 9/28 |
| WO | WO 2007/091559 | A1 * | 8/2007 | G21F 9/28 |

OTHER PUBLICATIONS

Chaudhary and Bhide, Electrochem. Decontamination of Metallic Surfaces Contaminated by Spent-Fuel Storage Pool Water, 98 Nuclear Tech. 242 (1992).*

* cited by examiner

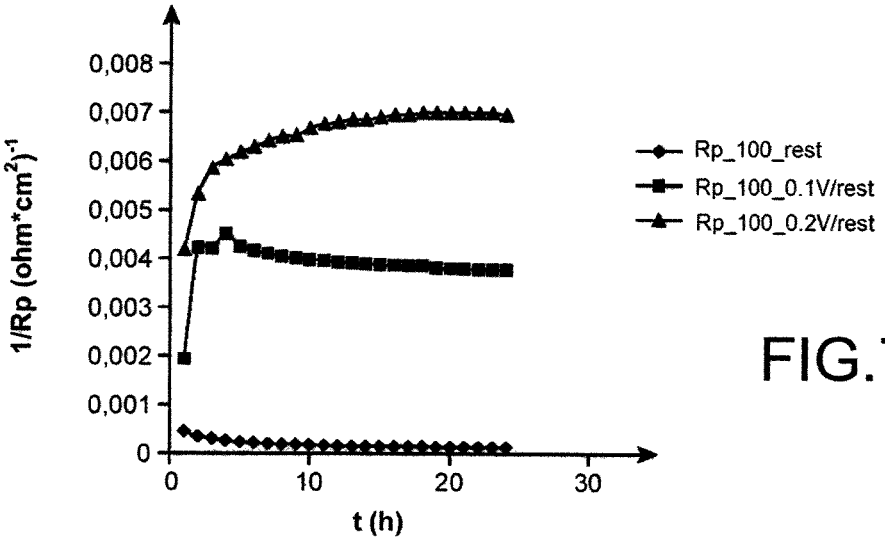
FIG.7
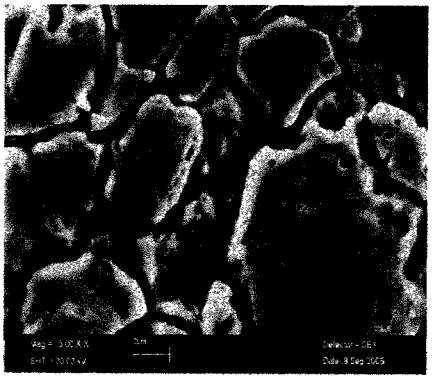
FIG.8
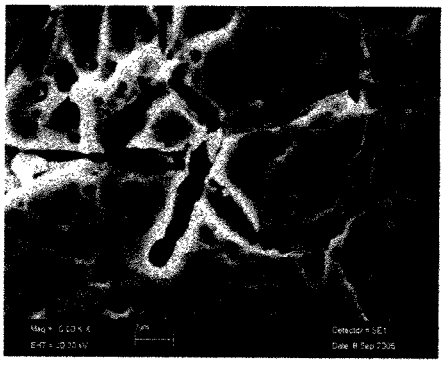
FIG.9
FIG.10
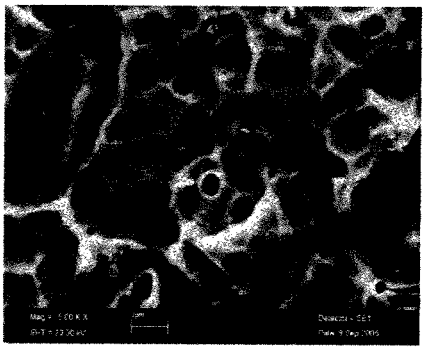

METHOD AND DEVICE FOR DECONTAMINATING A METALLIC SURFACE

TECHNICAL FIELD

The field of the present invention concerns the decontamination of installations, notably the field pertaining to the radioactive decontamination of the walls and metallic constituent parts of nuclear installations.

The present invention proposes a method for decontaminating said installations, which entails chemical etching by oxidative erosion using manganese VII as oxidant, combined with intermittent polarisation of the surface to be decontaminated. The present invention also concerns the device used for this decontamination.

STATE OF THE PRIOR ART

Radioactive contamination, comprising metal oxides containing radioelements, adheres to the walls of the constituent parts of nuclear reactors or of irradiated fuel treatment plants via phenomena of surface adsorption. Therefore erosion of 2 to 10 μm is considered to be sufficient for decontamination thereof.

To decontaminate metallic surfaces, notably those of the constituent parts of pressurised water nuclear reactors, or the metal walls of equipment from nuclear installations being dismantled, bibliographic research has shown the feasibility of treatment methods which oxidize the surface of AISI 304L stainless steel, using a sufficiently concentrated solution of oxidant and nitric acid. More particularly, the decontamination of stainless steel is possible using as oxidant manganese VII in a nitric acid medium, or cerium IV in an ozonated nitric acid medium (ozonated air or oxygen). These results are already described in patent applications [1-4]. In this state of the art, decontamination is conducted at temperatures of up to 80° C. [1] in a 0.035-0.1 M nitric acid medium.

Therefore, the powerful oxidant proposed may be cerium (IV) [1] or manganese (VII) [2-4]. Their redox potentials are very high: 1.74 V/SHE and 1.51 V/SHE respectively for the pairs $Ce^{4+}/Ce^{3+}$ and $MnO_4^-/Mn^{2+}$.

Compared with cerium, manganese has the advantage of being easy to manage after decontamination since it is notably acceptable by all channels for the treatment of liquid radioactive effluent. Discharge treatment is reversibly harnessed and made secure.

However, with respect to manganese, throughout the process there is spontaneous formation of manganese IV oxide ($MnO_2$) since manganese VII ($MnO_4^-$) (E° $MnO_4^-/MnO_2$=+1.62 V/SHE) reacts with water (E° $O_2/H_2O$=+1.23 V/SHE). A deposit of $MnO_2$ necessarily forms on the surface of parts in stainless steel to be decontaminated. This deposit induces a progressive decrease in the available concentration of manganese VII, and the corrosion rate of the metal is therefore substantially slowed. The efficacy of the oxidant also decreases rapidly over time. In addition, the onset of a deposit of $MnO_2$ on the metal is harmful in terms of decontamination efficacy, since the surface is made inaccessible to oxidation.

Prior patent applications using manganese VII mention these shortcomings, and are led to using high concentrations of oxidant [2-4]. As examples, the concentrations of Mn VII proposed in these documents are the following: 0.948-15.800 g [2]; 1.0-5.0 g [3]; 0.5-1.4 g [4] over varying treatment times which are respectively of the order of 24 h, 2 h and 8 h. Another technical solution put forward to solve the problem of $MnO_2$ precipitation, consists of agitating the oxidizing solution via ultrasound or bubbling a gas [3].

These additions of manganese are to be managed as waste and stored. The quantity of manganese to be used for decontamination must necessarily be reduced to the strict minimum necessary.

A further drawback of manganese is the relative instability thereof in an aqueous solution, necessitating the use of stabilising, generally reducing, products at the end of the treatment to prevent any non-controlled precipitation. These stabilising agents may be:

organic such as alkaline gluconate [2], ascorbic acid [3], citric acid [3], EDTA [3], dehydroascorbic acid [4], ascorbic acid [4], aldols [4], reducing sugars [4], or inorganic such as sodium hydroxide [2].

The use of these irreversible stabilisers leads to more complex treatment of decontamination effluent.

There is therefore a real need for a decontamination method using manganese as oxidant in reasonable quantities, whose efficacy is maintained throughout the course of said method and which requires few or no stabilising agents.

DISCLOSURE OF THE INVENTION

The present invention sets out to provide a decontamination method which entails chemical etching via oxidative erosion using the oxidant manganese VII ($MnO_4^-$) to drive corrosion, which meets the afore-mentioned needs and technical problems.

Throughout the method according to the present invention, the depositing of $MnO_2$ by precipitation on the surface to be decontaminated is reduced to a minimum and is even fully avoided. On this account, during the entire treatment process, the oxidizing capacity of manganese VII is maintained constant without requiring the use of high initial quantities of this oxidizer, or an additional supply of manganese during the treatment.

Finally, the method of the present invention is noteworthy since it can be used to decontaminate a metallic surface but also to erode any metallic surface by oxidation whether or not radioactive elements are attached to this surface.

Therefore, the present invention concerns a method for erosion by oxidation or for decontamination of a metallic surface, comprising a step consisting of polarising the metallic surface to be eroded or decontaminated placed in contact with a solution S containing manganese VII, at an electric potential that is more anodic than the corrosion potential of said surface.

As presented in the experimental section below, the work by the inventors has been able to evidence that, by bringing the metallic surface to be eroded or decontaminated to a sufficient potential, it is possible to maintain the manganese in its oxidizing form Mn VII on the surface of the metal, and to prevent the precipitation of $MnO_2$ on this surface.

By <<metallic surface>> under the present invention is meant a surface formed of at least 80%, notably at least 90%, particularly at least 95% and more particularly of at least 99% of a metal or mixture of metals. Advantageously, said metallic surface only contains metal.

The metal or mixture of metals forming said metallic surface or present therein has a valence of 0. Advantageously, the metal is chosen from among stainless steels such as austenitic steel, martensitic steel, ferritic steel and ferritic-austenitic steel, and more particularly from among INCOLOY® steel, INCONEL® steel, AISI 304 L stainless steel and AISI 316 L stainless steel.

In addition, the method according to the present invention is able to be implemented on any metallic surface irrespective of size or shape. The surface to be eroded or decontaminated is a metallic wall notably of an internal circuit, of a duct, of a nuclear reactor, of equipment in a plant treating irradiated nuclear fuel, and of a primary circuit in a nuclear reactor cooled by pressurised water.

Advantageously, the anodic overpotential between the electric potential to which the metal surface is polarised and the corrosion potential of said surface lies between 0.005 and 0.800 V, notably between 0.010 and 0.500 V, particularly between 0.020 and 0.200 V and more particularly between 0.050 and 0.100 V.

In the present invention, the electric potential at which the metal surface is polarized during the method is designated $E_{applied}$ and the corrosion potential of said metallic surface $E_{rest}$. Therefore the anodic overpotential applied to the metallic surface to be eroded or decontaminated and designated n is such that $\pi=E_{applied}-E_{rest}$.

Interestingly, the inventors have realized that by applying a more anodic electric potential to the metallic surface to be eroded or decontaminated than the corrosion potential of said surface, and in intermittent manner, it is possible to prevent electrolysis of the electrolyte and notably the release of hydrogen gas throughout the method according to the present invention.

Therefore, the polarisation used under the present invention is advantageously intermittent and generated by at least one electric pulse. More specifically, this polarisation is generated by at least 2, notably at least 5, in particular at least 10, and more particularly at least 20 electric pulses/sec. The different electric pulses used during one same erosion or decontamination cycle are independent of each other in terms of duration and intensity. Similarly, the frequency of the electric pulses over one same cycle may or may not be constant.

Advantageously, the duration of each pulse, during intermittent polarisation of the surface to be eroded or decontaminated according to the method of the present invention, ranges from about 1 sec to about 1 h; notably from about 10 sec to about 45 min; in particular from about 1 min to about 30 min and, more particularly from about 100 sec to about 1000 sec.

Under the present invention, by <<about x sec>>, <<about x min>> and <<about x h>>, x being an integer such as listed above, is respectively meant <<x sec±(x/10) sec>>, <<x min±(x/10) min>> and <<x h±(x/10) h>>.

In particular, the frequency of the pulses, during intermittent polarisation of the surface to be eroded or decontaminated according to the method of the present invention, lies between 250 $h^{-1}$ and 0.05 $h^{-1}$, notably between 100 $h^{-1}$ and 0.1 $h^{-1}$ and in particular between 50 $h^{-1}$ and 0.5 $h^{-1}$.

The method for oxidative erosion or for decontamination of a metallic surface according to the present invention is characterized by intermittent oxidations and by low anodic overpotentials. Under these conditions, the current densities on the metallic surface to be eroded or decontaminated are very low and advantageously lie between 0.1 and 5.0 $A\cdot m^{-2}$, notably between 0.2 and 2.0 $A\cdot m^{-2}$, and in particular between 0.5 and 1.0 $A\cdot m^{-2}$.

The oxidizing solution S containing the corrosion driving force i.e. manganese VII ($MnO_4^-$) contacted with the surface to be eroded or decontaminated according to the method of the present invention, is advantageously an aqueous solution. This solution S, in addition to manganese VII, May comprise an acid. This acid is advantageously a mineral acid. Said acid can be chosen from the group comprising nitric acid, phosphoric acid, hydrochloric acid and sulphuric acid.

In particularly advantageous manner, the oxidizing solution S containing the driving force for corrosion i.e. manganese VII ($MnO_4^-$) placed in contact with the surface to be eroded or decontaminated according to the method of the present invention, comprises nitric acid.

The acid, in particular nitric acid, which may be contained in the oxidizing solution S contacted with the surface to be eroded or decontaminated, notably imparts ion-permeability to the passivation layer of the metal surface, thereby making this surface sensitive to oxidative corrosion. This is of particular importance when the metal of the surface to be eroded or decontaminated contains stainless steel.

The acid and notably nitric acid, which may be contained in the oxidizing solution S contacted with the surface to be eroded or decontaminated, is present at a concentration of between 0.01 and 10 moles/L, notably between 0.05 and 5 moles/L, in particular between 0.1 and 3.5 moles/L and, more particularly, between 0.5 and 2 moles/L of oxidizing solution S.

During the oxidation reaction of the metal surface to be eroded or decontaminated according to the method of the invention, manganese VII is reduced to manganese II. It therefore needs to be regenerated. Any reaction involving a compound more oxidizing than manganese VII can be used for this regeneration.

However, the method for catalytic erosion or decontamination of a metallic surface according to the present invention is implemented in the presence of ozone. Advantageously, said method is conducted under ozone flushing. As described in application FR 2 792 763 [1] for the pair Cerium IV/Cerium III, ozone is used under the present invention to regenerate manganese VII from manganese II.

The ozone can be dissolved, placed in solution or added to the solution containing the manganese VII used for the method according to the invention, following any technique known to the one skilled in the art which allows the dissolution, placing in solution or adding of ozone to a solution.

In one particular embodiment, the ozone is added directly to the manganese-containing solution in the form of an ozone-containing gas. This embodiment is notably the form used in application FR 2 792 763 [1]. Said gas, in addition to ozone, advantageously comprises at least one gas chosen from among oxygen and nitrogen. The gas added to the solution S containing manganese VII and optionally manganese II is more particularly chosen from among ozonated air and ozonated oxygen.

The ozone content of the ozone-containing gas used under the present invention lies between 1 and 600 $g/Nm^3$, notably between 5 and 400 $g/Nm^3$, in particular between 10 and 250 $g/Nm^3$, and further particularly between 20 and 50 $g/Nm^3$.

In a first variant of this embodiment, the ozone-containing gas is added to the solution S of the method according to the invention by means of two gas-liquid contacting members which may either be transfer, naturally submerged or vacuum air-lifts and/or mixer air-lifts.

In a second variant of this embodiment, the ozone-containing gas is added to the solution S of the method according to the invention by direct injection by means of any immersed piping via which a liquid or gaseous reagent can be added.

In these two variants, the means used ensure the transfer of ozone into the manganese-containing solution to regenerate manganese II to manganese VII, and ensure the maintaining of most of the manganese content in Mn VII form in the solution S used in the oxidative erosion or decontamination method of the present invention.

It is to be noted that the rate of corrosion of a metal surface such as stainless steel in a nitric acid medium and in the presence of ozone alone is very slow, since ozone is scarcely soluble in an aqueous medium.

Advantageously, the manganese used in the method of the invention is initially added to the solution S in the form of manganese II ($Mn^{2+}$), manganese IV ($MnO_2$) manganese VII ($MnO_4^-$) or a mixture thereof.

By <<mixture>> under the present invention is meant a mixture comprising two or three forms of manganese at different oxidation states.

One original aspect of the method according to the invention lies in the fact that the manganese can initially be added to the solution S indifferently in forms Mn II, Mn IV or Mn VII. It is then converted to Mn VII, the majority species in the electrolyte, under the conditions of implementation of the method according to the invention. The one skilled in the art, without displaying any inventive step, will in particular be able to adapt the conditions of temperature, pH and potential applied during polarisation of the metal surface to be eroded or decontaminated.

In one variant, the conversion to manganese VII $(MnO)_4^-$) of manganese II ($Mn^{2+}$) or of manganese IV ($MnO_2$) can be obtained through the use of ozone in a nitric acid medium under conditions such as those defined for regeneration of Mn VII from Mn II.

The oxidative erosion and notably decontamination method of a metallic surface according to the present invention is noteworthy in that it allows a very small initial quantity of manganese to be used, since its efficacy remains constant throughout said method.

Advantageously, the manganese is initially added in Mn VII, Mn IV or Mn II form, at a concentration of less than 500 mg/L, notably of between 10 and 400 mg/L, in particular between 20 and 200 mg/L, and more particularly between 50 and 100 mg/L of solution S.

The method according to the present invention may comprise a subsequent step consisting of stabilising manganese VII to manganese II, a form which is fully stable in an aqueous medium.

By <<subsequent step>> under the present invention is meant a step conducted when the oxidative erosion or decontamination of the metal surface, in the presence of an oxidizing solution containing manganese VII, and when the polarisation of the said surface are considered to be sufficient. The one skilled in the art will know the expedient moment to implement this stabilisation without the need for any inventive effort. Any known step for stabilising manganese VII to manganese II can be used under the present invention.

It is to be noted however that having regard to the minimal quantity of manganese required by the method of the invention, this stabilisation step is an optional step, contrary to prior art decontamination techniques.

In one particular embodiment of this stabilisation, it may be necessary to add a stabilising agent to the solution S, e.g. reducing stabilising agents. Any known stabilising agent, whether organic or inorganic, can be used. For example, it may be chosen from among alkaline gluconate, ascorbic acid, citric acid, EDTA, dehydroascorbic acid, ascorbic acid, aldols, reducing sugars, sodium hydroxide and oxygenated water.

Advantageously the reducing stabilising agent used in the method of the invention is oxygenated water ($H_2O_2$). This reducing compound stabilises manganese VII to Mn II form. During this reaction, the oxygenated water breaks down into water, which means that the operation does not therefore add any other substance to the solution S. Additionally, once the oxygenated water has disappeared through decomposition, the manganese can again be brought to valence state VII through repeat ozone injection, making the stabilisation operation reversible. With this particular embodiment, the method of the present invention may have at least 2, notably at least 3, in particular at least 5 and more particularly at least 10 oxidation/stabilisation cycles.

The quantity of oxygenated water which can be added to the solution S with a view to stabilising manganese VII lies between 0.001 and 0.5 mol/L, notably between 0.005 and 0.4 mol/L, in particular between 0.01 and 0.2 mol/L and more particularly between 0.05 and 0.1 mol/L of solution S.

It is to be pointed out that the stabilisation step of the method according to the invention is not compulsory. The one skilled in the art will be able to determine whether or not it is needed. It may effectively be of advantage to maintain the manganese in the form of manganese IV, notably to precipitate the decontamination effluent and thereby subject such effluent to pre-decontamination.

The oxidative erosion or the decontamination method of a metallic surface according to the present invention may further comprise at least one prior step for one or more rinses, advantageously non-corrosive rinses, to eliminate easily removable contamination and/or the main deposits adhering to the metallic surface. Said step is performed before the oxidation step. The one skilled in the art knows different solutions which can be used for this or these different rinses.

To summarise, the method for oxidative erosion or the decontamination of a metallic surface according to the present invention advantageously comprises the following steps, consisting of:

a) optionally, subjecting the metallic surface to be eroded or decontaminated to at least one non-corrosive rinse;

b) placing manganese in solution e.g. manganese II, manganese IV, manganese VII;

c) optionally, contacting the solution obtained at step (b) with ozone, notably in the forms of embodiment envisaged above;

d) contacting said metallic surface to be eroded or decontaminated with the solution obtained after step (b) or optionally after step (c);

e) polarising said metallic surface to be eroded or decontaminated, in contact with the solution obtained after step (b) or optionally after step (c), at a more anodic electric potential than the corrosion potential of said surface, notably in the forms of embodiment envisaged above;

f) optionally, stabilising the manganese VII contained in said solution to manganese II, notably under the forms of embodiment envisaged in the foregoing (i.e. halting nitrogen flushing and/or using a stabilising agent such as oxygenated water).

The solution prepared at steps (b) and (c), as previously envisaged and under the conditions previously envisaged, is an aqueous solution advantageously containing an acid such as nitric acid. The quantity of manganese placed in solution at step (b) is the amount previously envisaged.

Steps (b)+(c) may optionally be implemented after step (d). Similarly, the contacting of said solution with ozone is advantageously maintained during steps (d) and (e) for the purpose of regenerating manganese II to manganese VII. Therefore, steps (d) and (e) are conducted in the presence of ozone.

Finally, the succession of steps (e) and (f) can be repeated at least 2 times, at least 3 times, at least 5 times or at least 10 times for cases when the stabilising agent used at step (f) is oxygenated water.

The oxidative erosion or the decontamination method of a metallic surface according to the present invention, and more particularly the oxidation step with polarisation of the metallic surface (step (e) above) are conducted at a temperature of more than 0° C., notably of between 0 and 85° C., in particular between 10 and 65° C. and more particularly between 20 and 50° C.

Similarly, steps (b) and (d) and the optional steps (a), (c) and (f) can each independently of one another be conducted at a temperature of more than 0° C., notably at between 0 and 85° C., in particular between 10 and 65° C. and more particularly between 20 and 50° C.

The oxidation step with polarization of the metallic surface (step (e) above) is performed over a time of between 1 and 72 hours, notably between 6 and hours, and in particular between 12 and 36 hours. The entirety of the method i.e. steps (b), (d) and (e) with the optional steps (a), (c) and (f), takes place over a time of between 2 and 96 hours, notably between 4 and 72 hours and in particular between 8 and 48 hours.

The present invention, having regard to the above-described advantages relating to the use of oxygenated water as stabilising agent for manganese VII, also concerns an erosion method by oxidation or a decontamination method of a metallic surface comprising an oxidizing treatment of said surface with manganese VII and a reducing treatment step with oxygenated water.

In this case, the oxidizing treatment step using manganese VII can be performed following any process known to the one skilled in the art using manganese VII to drive corrosion, and notably any of the processes described in patent applications [2-4].

The different forms of embodiment already described for the use of oxygenated water as reducing agent also apply mutatis mutandis to the reducing treatment step of the method of the invention.

The present invention also concerns a device which can be used for some aspects of the method according to the present invention, and notably for a method which firstly involves polarisation of the surface to be eroded or decontaminated, and secondly flushing with nitrogen.

Said device comprises:

means adapted to add ozone to a solution, and means adapted to polarise a metallic surface.

The means already described to add ozone to a solution can be used for the device according to the present invention. These means comprise at least one element and advantageously at least two elements chosen from among transfer, naturally submerged or vacuum air-lifts; mixer air-lifts and immersed piping to add a liquid or gaseous reagent.

The means adapted to polarise a metal surface advantageously comprise a direct current or voltage generator, means adapted for the electric connection of said metallic surface with said generator, and means adapted to control and command said generator to ensure intermittent polarisation of said surface at the desired potential.

The device according to the present invention may also comprise means adapted for the production of ozone, and optionally means adapted for adding a stabilising agent such as oxygenated water to a solution.

Chemical Aspect of the Method According to the Present Invention

Redox Reactions

The manganese in oxidation state Mn VII drives the corrosion reaction, allowing oxidation of the metal such as AISI 316L (M°) stainless steel of which the installation is formed.

The reaction involved in a nitric acid medium is:

$$n\text{Mn VII}+5\text{M}^0 \Leftrightarrow n\text{Mn II}+5\text{M}^{+n}$$

where 2<n<6)

Manganese (Mn VII) is capable of oxidizing the different constituent elements of the metal such as AISI 316L stainless steel, e.g.:

$$\text{Fe} \rightarrow \text{Fe}^{2+}+2e^-(E°=-0.44\text{V/SHE}) \text{ and}$$ iron:

$$\text{Fe}^{2+} \rightarrow \text{Fe}^{3+}+1e^-(E°=+0.77\text{V/SHE})$$

$$\text{Ni} \rightarrow \text{Ni}^{2+}+2e^-(E°=-0.25\text{V/SHE})$$ nickel:

$$\text{Cr} \rightarrow \text{Cr}^{6+}+6e^-(E°=-0.74\text{V/SHE})$$ chromium:

Regeneration of the Corrosion Driving Force

Throughout the oxidization reaction of steel, manganese VII is reduced to manganese II, hence the need for regeneration thereof. This entails the use of a compound that is more oxidizing than manganese VII.

This regeneration is achieved using ozone as per the following reaction:

$$5\text{O}_3+2\text{Mn II}+10\text{H}^+ \Leftrightarrow 5\text{O}_2+2\text{Mn VII}+5\text{H}_2\text{O}$$

Since the ozone regenerates the oxidants, it is possible to achieve continuous metal attack via the regeneration of Mn VII.

Stabilisation of the Reaction Medium

At the end of the reaction, the addition of oxygenated water stabilises manganese VII to valence state II as per the following reaction:

$$\text{Mn VII}+5/2\text{H}_2\text{O}_2+5\text{H}^+ \Leftrightarrow \text{Mn II}+5\text{H}_2\text{O}$$

Other characteristics and advantages of the present invention will become further apparent to the one skilled in the art on reading the illustrative examples given below which are non-limiting, with reference to the appended figures.

BRIEF DESCRIPTION OF THE DRAWINGS

FIG. 7 shows the influence of the applied potential on the corrosion rate (1/Rp) of AISI 304L stainless steel, in which [Mn II]=100 mg/L, [$HNO_3$]=0.5 M and at a temperature of 37° C.

FIG. 8 is a SEM photograph of the surface of AISI 304L stainless steel after 24 h corrosion in a 0.5 M solution of $HNO_3$, where [MnII]=100 mg/L, at a temperature of 37° C. and where E=$E_{rest}$.

FIG. 9 is a SEM photograph of the surface of AISI 304L stainless steel after 24 h corrosion in a 0.5 M $HNO_3$ solution, where [MnII]=100 mg/L, at a temperature of 37° C. and where E=+0.1 V/$E_{rest}$.

FIG. 10 is a SEM photograph of the surface of AISI 304L stainless steel after 24 h corrosion in a 0.5 M $HNO_3$ solution, where [MnII]=100 mg/L, at a temperature of 37° C. and where E=+0.2 V/$E_{rest}$.

DETAILED DESCRIPTION OF PARTICULAR EMBODIMENTS

The objective of the study is to present the optimal operating conditions allowing limited formation of manganese IV oxide ($MnO_2$), thereby obtaining maximum corrosion of AISI 304L stainless steel with a minimum addition of manganese to the nitric acid medium held under constant ozone flushing (ozonated oxygen or air).

In a first part, the behaviour of AISI 304L steel was studied by setting the Surface/Volume (S/V) ratio and causing the different parameters to vary such as the initial concentration of manganese II ($Mn^{2+}$), the concentration of nitric acid and temperature. The optimal conditions for corrosion of AISI 304L stainless steel can thereby be determined. This study was conducted in an electrochemical cell with three electrodes. The saturated calomel electrode provided with double junction was used as reference electrode, and the platinum electrode as auxiliary electrode.

In the second part, the corrosion of steel was studied in a 2 liter-reactor under the optimal conditions previously determined in the electrochemical cell. The results obtained allow validation of the operation conditions of the method. Subsequently, an anodic overpotential relative to the corrosion potential was applied to the steel. This anodic overpotential must avoid precipitation of manganese IV on the surface of the steel and hence keep the concentration of Mn VII constant in the electrolyte over time, thereby maintaining the corrosion rate of the stainless steel throughout the decontamination process. The non-precipitation of $MnO_2$ on the surface of the stainless steel was verified under these conditions.

The morphology of the surface after corrosive attack on the stainless steel was examined under scanning electron microscopy (SEM) and mass loss was determined using a micro-balance.

I. Electrochemical Cell Study

An electrochemical cell study allowed the experimental conditions to be determined (concentrations of Mn, nitric acid and temperature).

I.1. Influence of the Initial Concentration of Manganese and of Nitric Acid Concentration on the Corrosion Rate of AISI 304L Stainless Steel at 37° C.

The ozone flow rate was set at 1.5 g/h/l and the S/V ratio at 34 $m^{-1}$.

The polarisation curves were plotted for different initial concentrations of Mn II [$Mn^{2+}$] with a nitric acid concentration set at 0.5 M.

The initial concentrations of Mn II used in this experiment were respectively: 0, 25, 50, 100, 150 and 200 mg/L.

Figure 1:
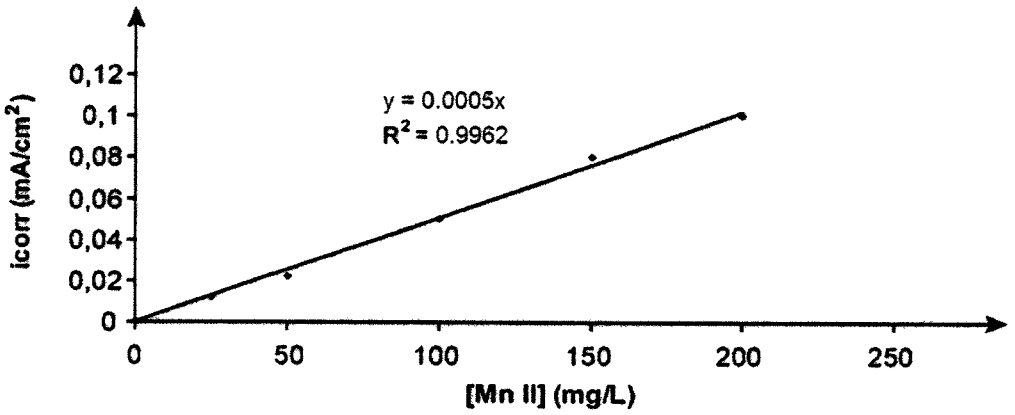
FIG. 1 shows the variation in density of the corrosion current of AISI 304L stainless steel with $[HNO_3]$=0.5 M and different initial concentrations of Mn II at a temperature of 37° C.

From the polarisation curves, the corrosion current density of the stainless steel was determined graphically (via the step value of cathodic diffusion-limited current) in relation to the initial concentration of Mn II [$Mn^{2+}$]. The results are given in FIG. 1.

The corrosion current density of AISI 304L stainless steel increases linear fashion with the initial concentration of Mn II in solution ([Mn II]).

The linear equation characteristic of this trend is:

$$i_{corr.}\ (\mathrm{mA \cdot cm^{-2}}) = 5 * 10^{-4}\ [\mathrm{Mn\ II}]\ (\mathrm{mg/L})$$

Figure 2:
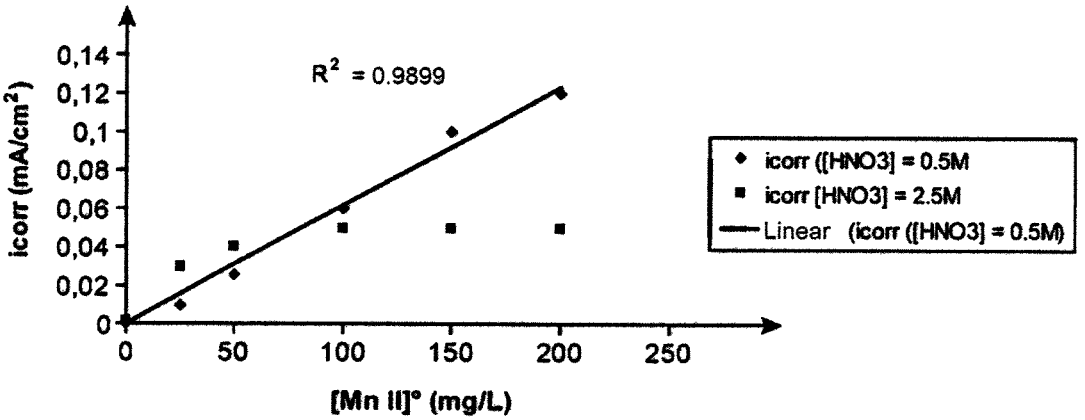
FIG. 2 shows the influence of nitric acid concentration on the density of the corrosion current of AISI 304L stainless steel at different initial Mn II concentrations and at a temperature of 37° C.

With the decontamination method, the nitric acid concentrations are generally higher than 0.5 M and may reach 2.5 M. Under these conditions, the rate of corrosion of stainless steel at 37° C. varies differently in relation to the initial Mn II concentration. The results comparing the two acidities are recorded in FIG. 2.

For the two different concentrations of nitric acid, the corrosion current density increases globally with the initial concentration of Mn II. However, with a nitric acid concentration of 2.5 M, the corrosion current density remains constant over and above an initial Mn II concentration of 100 mg/L.

Therefore, for initial concentrations of Mn II equal to or higher than 100 mg/L, the corrosion current density of stainless steel for a nitric acid concentration of 0.5 M becomes higher than that obtained with a nitric acid concentration of 2.5 M.

To conclude, at 37° C., the corrosion rate of stainless steel increases with the initial concentration of Mn II present in solution in a nitric acid medium of low concentration (0.5 M). However, corrosion does not appear to be helped by an increase in the initial concentration of Mn II when the nitric acid concentration reaches 2.5 M.

When measurements were taken, a deposit of $MnO_2$ was seen on the surface of AISI 304L steel. This deposit is much greater with a nitric acid concentration of 2.5 M. It is the formation of this deposit which reduces the efficacy of the oxidant. A high initial concentration of manganese would be of no use under these conditions.

I.2. Influence of Temperature and Initial Manganese Concentration on the Corrosion Rate of AISI 304L Stainless Steel.

Figure 3:
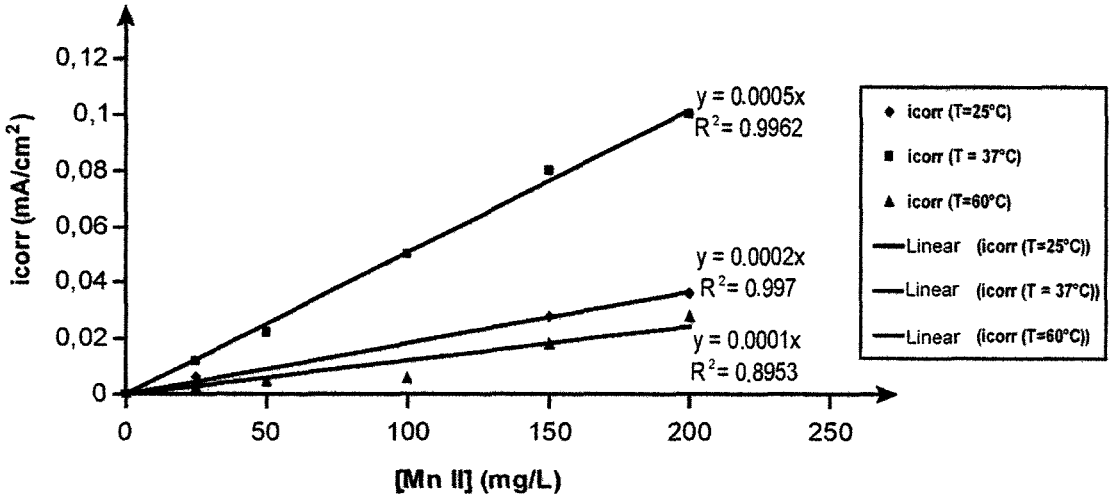
FIG. 3 shows the influence of temperature on the density of the corrosion current of AISI 304L stainless steel at different initial Mn II concentrations and with $[HNO_3]$=0.5 M.

The changes in the corrosion current density of AISI 304L stainless steel in relation to temperature and to initial Mn II concentration (FIG. 3) are comparable with those observed with a nitric acid concentration of 0.5 M and at a temperature of 37° C.

The corrosion current density increases with the initial Mn II concentration but in different manner depending upon temperature. A rise in temperature to 60° C. has an adverse effect on the corrosion rate of stainless steel. At this latter temperature, the black deposit of $MnO_2$ is much greater than in all other cases. It increases further with an increase in the concentration of nitric acid.

Temperature is a kinetic factor which benefits the rate of $MnO_2$ formation, and this (at 60° C.) leads to a reduction in the corrosion rate of stainless steel compared with temperatures of 25° C. and 37° C.

At 25° C., the formation of manganese oxide remains negligible, but the temperature is not high enough to allow corrosion of stainless steel that is comparable with that observed at 37° C.

I.3. Conclusion.

According to our results, in an electrochemical cell, the corrosion rate of stainless steel increases with the initial concentration of Mn II over the range 0-200 mg/L and with a 0.5 M concentration of nitric acid and an ozonated medium (ozonated air or oxygen).

However, an increase in temperature to 60° C. and/or in the concentration of nitric acid promotes the formation of a black deposit of $MnO_2$. The formation of this deposit reduces the efficient concentration of oxidant ($MnO_4^-$), which leads to a decrease in the corrosion rate of stainless steel.

II. Reactor Study

Study in a reactor allows the corrosion rate of AISI 304L stainless steel to be evaluated under real decontamination conditions, and allows examination of the conditions to avoid the formation of $MnO_2$.

II.1. Experimental Conditions

Two 2-liter reactors are mounted in series. To the first reactor designated reactor 1 hereunder, are added the nitric acid solution and the manganese nitrate (Mn II). This reactor 1 is supplied with ozone (ozonated air or oxygen) by means of an air-lift and is filled with the solution to be oxidized. The inlet flow rate of ozone (ozonated oxygen) into the reactor 1 is set at 10 L/h. The ozone concentration at the input to the reactor 1 is 72 g/Nm$^3$. It is in this reactor 1 that complete oxidation takes place of colourless Mn II ($Mn^{2+}$) to purple Mn VII ($MnO_4^-$).

Once the reaction of Mn VII formation is completed, the oxidizing solution is decanted into the second reactor (reactor 2) in which the sheets of AISI 304L stainless steel have already been placed with a Surface/Volume ratio of 64 m$^{-1}$. The constant, continuous flow of ozone is maintained throughout the experiments to ensure regeneration of Mn VII.

The temperature of the electrolyte inside the reactor 2 is held constant by means of a thermostat and the double jacket provided on this reactor.

A saturated calomel reference electrode and a platinum electrode were used for all electrochemical measurements.

The reactor study used:

40 cm$^2$ sheets of AISI 304L stainless steel;

initial Mn II concentrations in solutions of 100 and 200 mg/L, for a nitric acid concentration of 0.5 M;

a temperature of 37° C.;

a time of 24 h.

II.2. Influence of Initial Mn II Concentration on the Rate of Corrosion of AISI 304L Steel After 24 h Attack at the Corrosion Potential.

Figure 4:
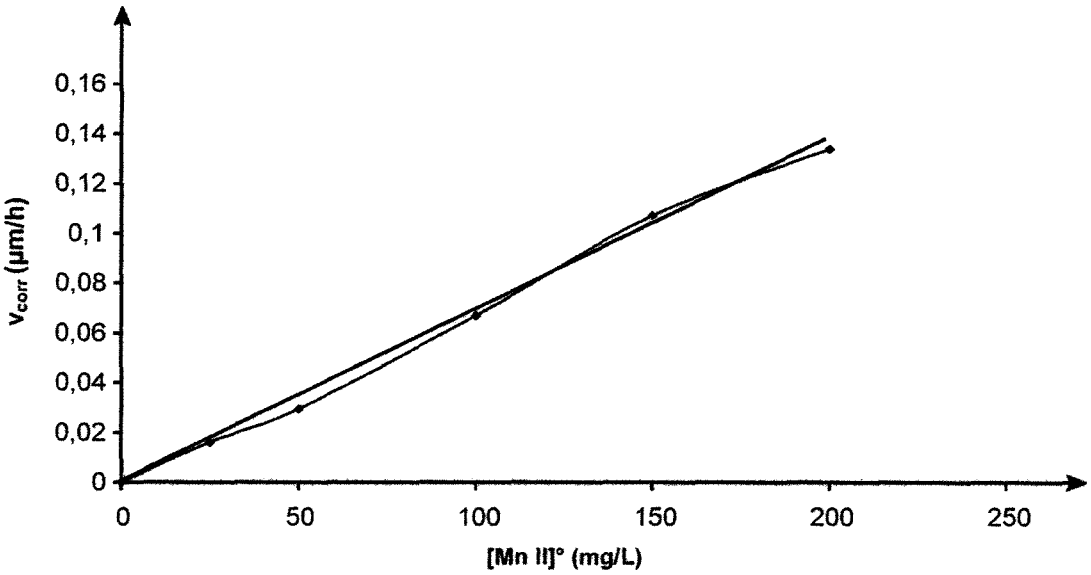
FIG. 4 shows the influence of Mn II concentration on the rate of corrosion of AISI 304L stainless steel over an attack time of 24 h, in 0.5 M nitric acid medium, at a temperature of 37° C. and with a surface/volume ratio of 64 $m^{-1}$.

The corrosion rate of stainless steel expressed in μm/h as a function of the initial Mn II concentration is given in FIG. 4. The results were obtained after an attack time of 24 h and with a 0.5 M nitric acid medium at 37° C.

The attack rate is proportional to the Mn II concentration. For an initial concentration of Mn II in solution of 100 mg/L, the mean corrosion rate of the stainless steel after 24 h was 0.07 μm/h. This value is already sufficient to ensure surface decontamination of installations.

II.3. Monitoring the Formation of $MnO_2$ Deposit. Measurement of Stainless Steel Polarisation Resistance During Treatment.

During the 24 h treatment of stainless steel in reactor 2, a deposit of $MnO_2$ was formed on the surface of the steel.

To evaluate the extent of this phenomenon, the changes in polarisation resistance $R_p$ (Ω·cm$^2$) of the steel was measured by electrochemical impedance spectroscopy (EIS) over the time period. This value was obtained from Bode or Nyquist diagrams determined at the corrosion potential of stainless steel, and by extrapolating the curve at low frequencies.

Figure 5:
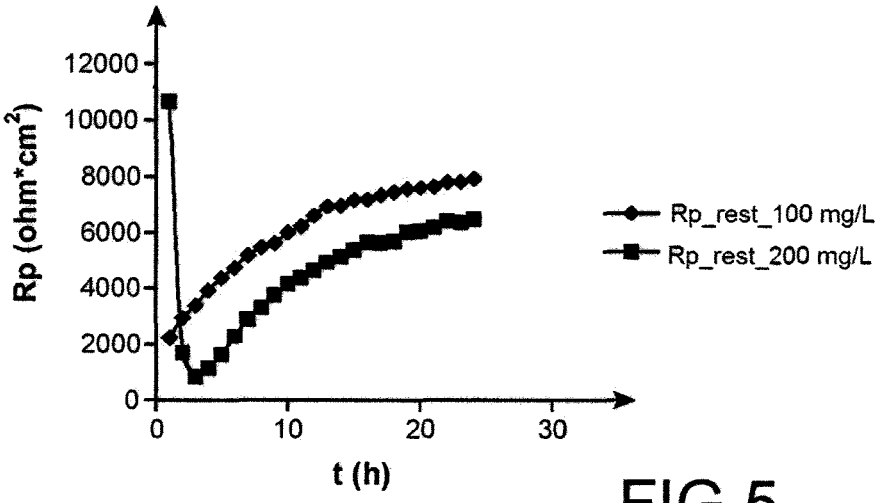
FIG. 5 shows the influence of initial Mn II concentration on time-related changes in the polarisation resistance of AISI 304L stainless steel measured at rest, with $[HNO_3]$=0.5 M and at a temperature of 37° C.

The variations in polarisation resistance throughout the duration of the process (i.e. 24 h) are given (FIG. 5) for:

a temperature of 37° C., a nitric acid concentration of 0.5 M, and the two concentrations of Mn II: 100 mg/L and 200 mg/L.

With an initial Mn II concentration of 100 mg/L, polarisation resistance increases from 2000 ohm·cm$^2$ to 8000 ohm·cm$^2$ over the course of time.

This phenomenon translates the formation of a $MnO_2$ deposit on the surface of the stainless steel. This deposit causes slowing of the corrosion rate of stainless steel over the 24 h period.

Similar results were obtained with an initial Mn II concentration of 200 mg/L. Polarisation resistance also increased over time on and after 3 h but nevertheless remained lower than that measured with [Mn II]=100 mg/L. Therefore, in this case also there was formation of $MnO_2$ deposit. This medium is more oxidizing, which accounts for Rp ([Mn II]=200 mg/L)<Rp ([Mn II]=100 mg/L). It would be equivalent to say that the corrosion rate increases when the concentration of oxidant is increased twofold.

I.4. Conclusion.

Measurements of the polarisation resistance (Rp) of stainless steel throughout the 24 h treatment in a reactor evidence a progressive increase in Rp even in cases when the nitric acid concentration is low (0.5 M) and the temperature scarcely high (37° C.). This increase in polarization resistance is also observed with a higher concentration of oxidant. This increase in Rp over time slows down the corrosion rate of stainless steel.

It is therefore necessary to propose a further element for corrosive attack of the medium, to limit the slowing effect of the $MnO_2$ deposit. This step must restrict or eliminate the formation of the $MnO_2$ deposit and not act as further attacking element for the oxidizing medium.

III. Anti-$MnO_2$ Deposit Electrochemical Treatment. Intermittent Oxidation of AISI 304L Stainless Steel.

To eliminate the formation of $MnO_2$ on the surface during attack of the stainless steel, the present inventors propose applying a slightly higher potential than the corrosion potential ($E_{rest}$) of stainless steel. This holding of the steel at a more anodic potential is intended solely to cause dissolution of the $MnO_2$ deposit. The corrosion rate of the metal does not need to be modified through this modification in potential since the oxidizing medium is already highly efficient. It is the maintaining of its efficacy that must be ensured over 24 h.

Therefore an overpotential of 0.1 V/$E_{rest}$ and of 0.2 W$E_{rest}$ was tested on sheets of 304L steel for a period of 10 min every hour, for example, and at the two previously cited Mn II concentrations. The time during which the electrode is held at a higher potential than the corrosion potential must be limited to re-solubilisation of the $MnO_2$ spontaneously formed in the reactor.

The time monitoring of polarisation resistance over 24 h for these different conditions allows determination of the efficacy imparted to the method if a potential is applied in addition to chemical corrosion.

III.1. Application of a Potential. Influence of Initial Mn II Concentration on Polarisation Resistance.

Figure 6:
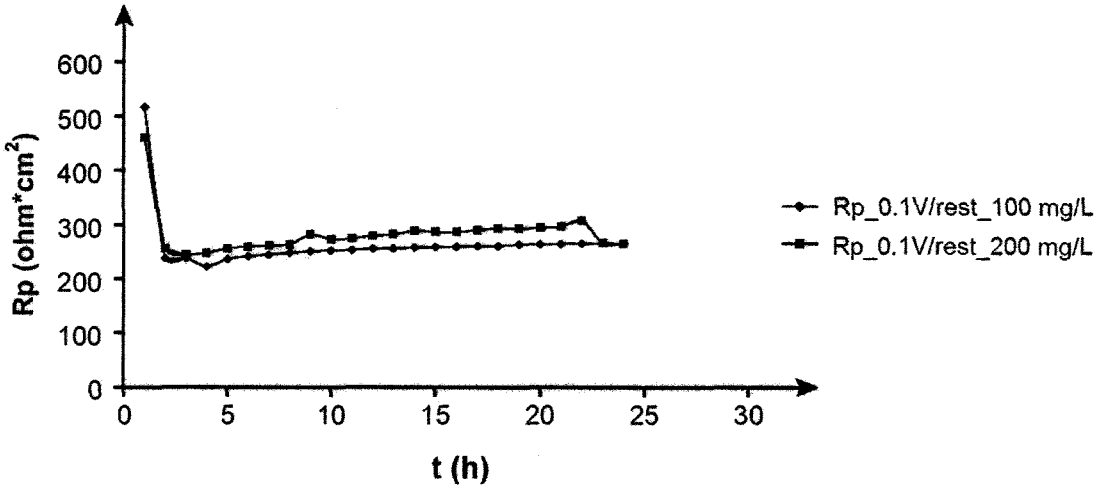
FIG. 6 shows the influence of Mn II concentration on time-related changes in the polarisation resistance of AISI 304L stainless steel measured at E=+0.1 V/$E_{rest}$, where [$HNO_3$]=0.5 M and at a temperature of 37° C.

The changes in polarisation resistance of AISI 304L stainless steel brought for 10 min/h to the potential +0.1 V/$E_{rest}$ in 0.5 M nitric acid medium at a temperature of 37° C., and with initial Mn II concentrations of 100 mg/L and 200 mg/L, are given in FIG. 6.

Contrary to the measurements made with the corrosion potential (FIG. 5), polarisation resistance remains constant over time for both initial Mn II concentrations of 100 mg/L and 200 mg/L. The intermittent application (10 min/h) of an anodic potential of +0.1 V/$E_{rest}$ to the stainless steel is sufficient and effectively eliminated the passivating effect of the $MnO_2$ deposit.

In addition, in both cases, the polarisation resistance values are very close. The initial Mn II concentration therefore appears to have little influence on polarisation resistance and hence on corrosion rate.

III.2. Influence of the Applied Potential on Corrosion Rate.

The influence of the applied potential on the corrosion rate (1/Rp) of stainless steel was compared, FIG. 7, under the same operating conditions: T=37° C., nitric acid concentration=0.5 M, initial Mn II concentration=100 mg/L, intermittent schedule=10 min/h. Three cases were envisaged:

no application of potential $E=E_{rest}$, $E_{applied}$=+0.1 V/$E_{rest}$, $E_{applied}$=+0.2 V/$E_{rest}$.

The intermittent application of an anodic potential of +0.2 V/$E_{rest}$ or +0.1 V/$E_{rest}$ to stainless steel significantly increases the corrosion rate (increase in 1/Rp ratio) compared with the tests using the corrosion potential ($E_{rest}$).

The corrosion rate also increases with application of a higher potential, but this is not the targeted objective. It is sufficient that the corrosion rate should remain constant throughout the decontamination treatment period with minimum perturbation. Therefore, according to these results, and notably under the experimental conditions used, intermittent application of a potential of +0.1 V/$E_{rest}$ is preferable.

III.3. Conclusion.

The application of an intermittent signal (e.g. 10 min/h) bringing the potential of stainless steel to a more anodic value $E_{applied}$=0.1 V/$E_{rest}$ prevents the formation of $MnO_2$ deposit, and allows the corrosion rate to be maintained constant throughout the entire duration of the decontamination treatment (24 h). The initial manganese concentrations can therefore be limited to 100 mg/L and will remain efficient 24 h without any additional manganese.

With intermittent oxidations and low anodic overpotentials, the current densities on stainless steel are very low. There is therefore no release of hydrogen to take into account on the auxiliary electrode in an aqueous medium that is saturated with ozonated oxygen or air and high in oxidant.

IV. Morphology of Corrosion.

IV.1. Mass Loss

Table 1 summarises the mass losses of the stainless steel plates after corrosion. The plates were subjected to:

either attack in a reactor at 37° C. for 24 h in 0.5 M nitric acid medium, with an initial concentration of Mn II=100 mg/L;

or attack in a reactor under the same conditions but, in addition, with intermittent polarisation for 10 min/h at +0.1 V/SHE;

or attack in a reactor under the same conditions but, in addition, with intermittent polarisation for 10 min/h at +0.2 V/SHE.

The mass losses obtained allow evaluation of the mass of formed $MnO_2$ deposit, and of the corrosion rates of stainless steel under these conditions (Table 1).

TABLE 1

Influence of the treatment on the corrosion rate of AISI 304L stainless steel (SS).

| Treatment | Initial mass of SS (g) | Mass after treatment (g) | Mass after $H_2O_2$ rinsing (g) | Mass of $MnO_2$ deposit (g) | Δm (by corrosion) (g) | $V_{corr}$ (μm/j) |
|---|---|---|---|---|---|---|
| $E = E_{rest}$ | 31.5498 | 31.5445 | 31.4795 | 0.065 | 0.07 | 2.3 |
| 0.1 V/$E_{rest}$ | 31.1362 | 31.0282 | 31.0251 | 0.003 | 0.111 | 3.6 |
| 0.2 V/$E_{rest}$ | 31.8369 | 31.6681 | 31.6661 | 0.002 | 0.171 | 5.5 |

T = 37° C.,
$[HNO_3]$ = 0.5M,
[Mn II] = 100 mg/L,
Intermittent oxidation 10 min/h.

These results confirm the formation of a $MnO_2$ deposit on the surface of the steel during corrosion of the stainless steel at the rest potential, and almost complete disappearance thereof when intermittent anodic oxidation is applied (10 min/h) in addition to corrosion. The application of low polarisation of +0.1 V/$E_{rest}$ appears to be sufficient. It allows a 56% increase in the mean daily corrosion rate of stainless steel.

IV.2. Comparison of Surfaces After Attack

The surfaces of the stainless steel sheets subjected to the different types of treatment (with or without intermittent anodic overpotential) were observed under SEM. The results are given FIGS. 8-10.

The SEM photographs (FIGS. 8-10) of the three surfaces of AISI 304L stainless steel evidence corrosion of intergranular type for the three treatments.

The corrosion appears to be more marked in cases when the steel sheets were subjected to a potential higher than the rest potential, and more particularly after application of a potential of +0.2 V/$E_{rest}$. This result is in keeping with the mass losses of the samples after corrosion.

Observations made on cross-sections of the steel confirmed these results.

REFERENCES

1. Patent application FR 2 792 763 (Commissariat à l'Energie Atomique) published on 27 Oct. 2000.

2. Patent application FR 2 641 895 (Commissariat à l'Energie Atomique) published on 20 Jul. 1990.

3. Patent application FR 2 644 618 (Commissariat à l'Energie Atomique) published on 21 Sep. 1990.

4. Patent application FR 2 850 673 (Electricité de France) published on 6 Aug. 2004.

The invention claimed is:

1. A method for oxidative erosion or for decontamination of a metallic surface, comprising:

polarizing the metallic surface to be eroded or decontaminated by chemical etching using oxidative erosion; and placing said polarized metallic surface in contact with an electrolytic solution containing an oxidant at a more anodic electric potential than a corrosion potential of said polarized metallic surface whereby electrolysis of the electrolytic solution is prevented, the electrolytic solution containing the oxidant including manganese VII, wherein said polarization is intermittent and is generated by at least one electric pulse;

an anodic overpotential between an electric potential at which the metallic surface is polarized and the corrosion potential of the polarized metallic surface is between 0.005 and 0.800 V; and said method is conducted in the presence of ozone; and current densities on the metallic surface to be eroded or decontaminated lie between 0.5 and 5.0 $A \cdot m^{-2}$.

2. The method according to claim 1, wherein the anodic overpotential between the electric potential at which the metallic surface is polarized and the corrosion potential of said surface is between 0.010 and 0.500 V.

3. The method according to claim 2, wherein the anodic overpotential between the electric potential at which the metallic surface is polarized and the corrosion potential of said surface is between 0.020 and 0.200 V.

4. The method according to claim 3, wherein the anodic overpotential between the electric potential at which the metallic surface is polarized and the corrosion potential of said surface is between 0.050 and 0.100 V.

5. The method according to claim 1, wherein a duration of each said at least one electric pulse is between about 1 sec and about 1 h.

6. The method according to claim 5, wherein the duration of each said at least one electric pulse is between about 10 sec and about 45 min.

7. The method according to claim 6, wherein the duration of each said at least one electric pulse is between about 1 min and about 30 min.

8. The method according to claim 7, wherein the duration of each said at least one electric pulse is between about 100 sec and about 1000 sec.

9. The method according to claim 1, wherein said at least one electric pulse comprises multiple electric pulses, and wherein a frequency of said multiple electric pulses ranges from 250 $h^{-1}$ to 0.05 $h^{-1}$.

10. The method according to claim 9, wherein said frequency of said multiple electric pulses ranges from 100 $h^{-1}$ to 0.1 $h^{-1}$.

11. The method according to claim 10, wherein said frequency of said multiple electric pulses ranges from 50 $h^{-1}$ to 0.5 $h^{-1}$.

12. The method according to claim 1, wherein said electrolytic solution contains nitric acid.

13. The method according to claim 1, wherein the manganese is initially added to said solution in the form of manganese II, manganese IV, manganese VII, or a mixture thereof.

14. The method according to claim 13, wherein the manganese is initially added to said solution at a concentration of less than 500 mg/L.

15. The method according to claim 14, wherein the manganese is initially added to said solution at a concentration of between 10 and 400 mg/L.

16. The method according to claim 15, wherein the manganese is initially added to said solution at a concentration of between 20 and 200 mg/L.

17. The method according to claim 16, wherein the manganese is initially added to said solution at a concentration of between 50 and 100 mg/L.

18. The method according to claim 1, further comprising: stabilizing manganese VII to manganese II.

19. The method according to claim 18, wherein said stabilizing comprises adding oxygenated water ($H_2O_2$) to said solution containing manganese VII.

20. The method for oxidative erosion or for decontamination of a metallic surface according to claim 1, wherein said method further comprises subjecting the metallic surface to be eroded or decontaminated to at least one non-corrosive rinsing, prior to said polarizing.

* * * * *